United States Patent [19]

Neumann

[11] 4,399,623

[45] Aug. 23, 1983

[54] DREDGES

[75] Inventor: John A. Neumann, Currumbin, Australia

[73] Assignee: Neumann Equipment Marketing Co. Pty. Ltd., Currumbin, Australia

[21] Appl. No.: 273,767

[22] Filed: Jun. 15, 1981

[30] Foreign Application Priority Data

Jun. 18, 1980 [AU] Australia ..... PE4080

[51] Int. Cl.[3] ..... E02F 9/00

[52] U.S. Cl. ..... 37/73

[58] Field of Search ..... 187/9 E; 37/73, 74; 212/157; 440/36

[56] References Cited

U.S. PATENT DOCUMENTS

| | | | |
|---|---|---|---|
| 371,680 | 10/1887 | Goodwin | 440/34 |
| 515,379 | 2/1894 | Titcomb . | |
| 533,739 | 2/1895 | Pless | 37/74 |
| 690,074 | 12/1901 | Osgood | 37/74 |
| 743,751 | 11/1903 | Perry . | |
| 786,968 | 4/1905 | Hollenbeck | 37/74 |
| 1,506,974 | 9/1924 | Cooley | 212/157 |
| 2,788,863 | 4/1956 | Ulinski | 187/9 E |
| 2,917,851 | 12/1959 | Ellicott, Jr. . | |
| 3,003,454 | 10/1961 | Shatoska et al. . | |
| 3,272,477 | 9/1966 | Schmidt | 37/74 |
| 3,325,923 | 6/1967 | Cargile | 37/73 |
| 3,656,449 | 4/1972 | Mead . | |
| 3,902,448 | 9/1975 | Davis . | |

FOREIGN PATENT DOCUMENTS

| | | | |
|---|---|---|---|
| 330837 | 6/1930 | United Kingdom . | |
| 1294077 | 10/1972 | United Kingdom . | |
| 1535746 | 12/1978 | United Kingdom . | |
| 209310 | 3/1968 | U.S.S.R. | 37/73 |

*Primary Examiner*—Trygve M. Blix
*Assistant Examiner*—Thomas J. Brahan
*Attorney, Agent, or Firm*—Schwartz, Jeffery, Schwaab, Mack, Blumenthal & Koch

[57] ABSTRACT

A dredge hull carries a first spud vertically slidable through a spud frame on a longitudinally slidable carriage, and a second spud vertically slidable through a spud frame on a fixed carrier. Each spud has lifting means for raising it vertically, locking means for locking it in raised position, and release means for releasing the locking means so the spud can drop and drive into the sea bed. With the second spud raised and the first spud dropped, advancing means move the hull forwards relative to the carriage. The lifting and locking means include a lifting plate above a locking plate, both apertured to receive the spud closely and permit its free passage when horizontal and lock it when tilted, the lifting plate being tilted when lifted hydraulically, the locking plate tilting gravitationally. When the lifting plate is lowered onto the locking plate, both are movable hydraulically to horizontal to let the spud drop.

4 Claims, 6 Drawing Figures

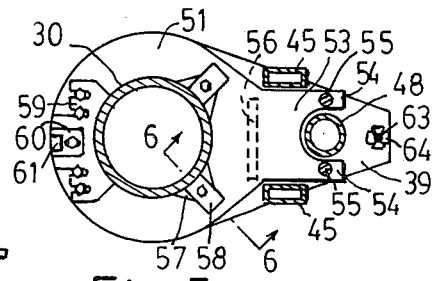
Fig. 5.
Fig. 6.
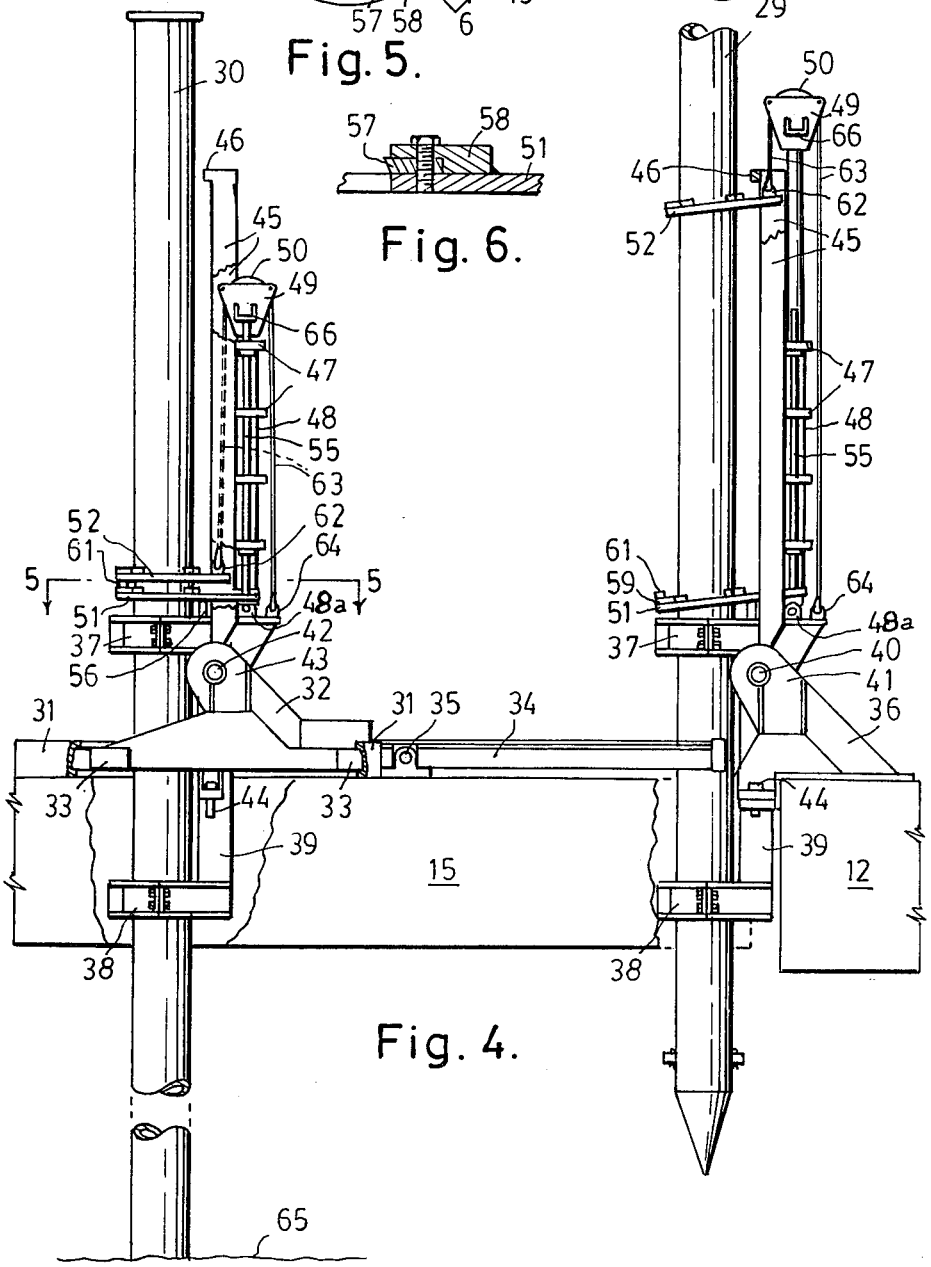
Fig. 4.

DREDGES

BACKGROUND OF THE INVENTION

This invention relates to improvements in dredges.

Dredges are well known and widely used for construction and maintenance work in harbours, canals, shipping facilities, mining sites and land reclamation. A well-known type of dredge has a hinged frame or ladder extending forwardly from its hull and carrying a bucket wheel which may be lowered to working depth by the ladder and driven to excavate soil which, with water, is pumped through a conduit and discharged on land.

The general object of this invention is to provide such a dredge which may be efficiently worked by a very small crew, a single operator being able to control the advance of the dredge, as well as the operation of the bucket wheel and the slewing of the dredge.

BRIEF DESCRIPTION OF THE INVENTION

The invention is applied to a dredge of the well-known type in which the hull is moved forwardly as and when required by operating a first spud and a second spud, each being carried by the hull in vertically slidable manner, and capable of being driven down into a sea bed to anchor the hull, and also to serve as a pivot about which the hull may be slewed. The first spud is vertically slidable through a spud frame on a carriage which is mounted on the hull for slidable movement longitudinally relative to the hull. The second spud is vertically slidable through a spud frame on a carrier which is fixed on the hull. For each spud there are provided lifting means for raising it, locking means for holding it in its raised position, and release means for releasing the locking means to permit the spud to drop and drive into the sea bed, propelling means being provided for advancing the hull relative to the spud carriage when the second spud has been raised, the first spud having been driven into the sea bed. The lifting means and locking means include an apertured lifting plate above an apertured locking plate, each of these being fitted closely about the spud which can pass freely through the plate when it is substantially perpendicular to the spud, the plate gripping the spud frictionally when tilted. The locking plate is fulcrumed at one side to tilt gravitationally so as to lock the spud against descent while permitting it to be lifted. The lifting means includes, in addition, hydraulic means for raising and lowering the lifting plate, tilting it when raising it to cause the lifting plate to grip and lift the spud. The release means is actuated by the hydraulic means, after the lifting plate has been lowered by it onto the locking plate, to move both the fulcrumed locking plate and the superimposed lifting plate from their tilted positions to positions in which they are both raised and substantially perpendicular to the spud. Preferably the hydraulic means consists of a hydraulic cylinder which raises or lowers a sheave engaged by a cable which is connected at one end to a side of the locking plate and at the other end to the spud frame.

BRIEF DESCRIPTION OF THE DRAWINGS

In the drawings:

FIG. 4 is a partly broken-away side view, to larger scale of the spudding assembly of the dredge, FIG. 5 is a sectional view, to still larger scale, along line 5—5 in FIG. 4, and FIG. 6 is a sectional view, to larger scale again, along line 6—6 in FIG. 5.

DETAILED DESCRIPTION OF THE PREFERRED EMBODIMENT

Figures 1, 2, 3:
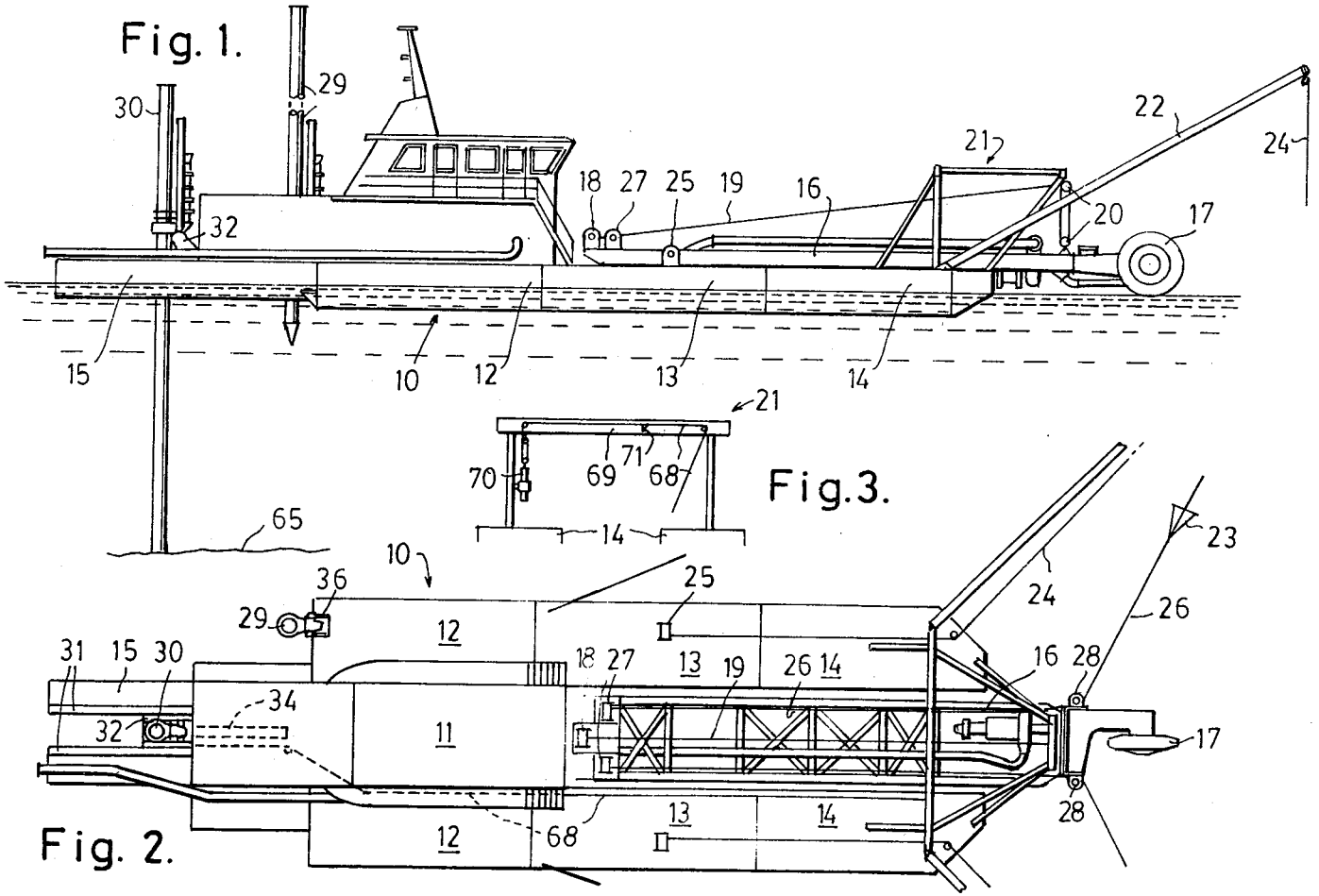
FIG. 1 is a side view of a dredge according to the invention.
FIG. 2 is a plan view of the dredge.
FIG. 3 is a rear view of the gantry and advance indicator of the dredge.

The dredge may be readily separated into parts, all of which are transportable by road or rail. The midship section 10 of the dredge consists of a middle pontoon 11 and two side pontoons 12 which are continued forward as two spaced parallel arms by the addition of intermediate pontoons 13 and bow pontoons 14, a spud pontoon 15 being demountably attached behind the middle pontoon 11 of the midship section 10.

A ladder section 16 between the two forwardly extending arms is hinged about a transverse axis at its rear and carries at its front a hydraulically driven bucket wheel 17 which may be lowered to working depth by a winch 18 and cable 19 carried through sheave blocks 20, one on a gantry structure 21 across the bow pontoons and one on the front of the ladder section 16.

A pair of booms 22 are used to place anchors 23, suspended by cables 24 from winches 25, to both sides of the dredge's bow, and the dredge may be slewed by cables 26 from winches 27 and reeved through slewing sleave blocks 28 on the ladder section 16.

The dredge carries two spuds 29 and 30 providing a pivot about which the dredge is slewed, and also for advancing the dredge, the front spud 29 being mounted behind one of the side pontoons 12 of the midship section 10, the rear spud 30 being mounted on the spud pontoon 15.

The spud pontoon 15 is divided centrally from its rear end, and a pair of oppositely directed channeled slide beams 31 are mounted on the two spaced parts of the pontoon. A spud carriage 32 for the rear spud 30 is slidable along the slide beams, having front and rear slide blocks 33 engaged in the channels of the beams. A double-acting hydraulic cylinder 34 is trunnion-mounted at 35 on the spud pontoon, its piston being connected to the spud carriage 32 to move it slidably in either direction along the slide beams.

A spud carrier 36 for the front spud 29 is fixedly mounted on the rear of a side pontoon 12.

Each of the spuds 29 and 30 is of metal tube with a pointed lower end, and it is slidable through top and bottom girth rings 37 and 38 of a spud frame 39. The spud frame 39 of the front spud 29 is pivoted about a transverse axis at 40 between a pair of apertured lugs 41 of the spud carrier 36, and the spud frame 39 of the rear spud 30 is pivoted about a transverse axis at 42 between a pair of similar lugs 43 of the spud carriage 32. Each spud is normally held vertical by a locking pin 44 inserted through brackets on its spud frame and on the pontoon on which the spud is mounted. On removal of the locking pins the spuds may be hingedly lowered to allow the dredge to pass under lower bridges.

Each spud frame 39 has a pair of parallel guide posts 45 extending above its top girth ring 37 and interconnected by a top cross-member 46 and a number of U-shaped brackets 47. A hydraulic cylinder 48 has its lower end pivoted between apertured lugs **48*a* on the spud frame 39 and extends up within the U-shaped brackets 47, its piston being fixed to a carrier 49 for a sheave 50. Each of the spuds 29 and 30 passes closely through circular apertures of a locking plate 51 and a lifting plate 52**.

The locking plate 51 is substantially circular with a forward extension 53 passing closely between the guide posts 45 and bifurcated to clear the hydraulic cylinder 48, its two front ends 54 suporting a pair of push rods 55 parallel to the spud and carried slidably in bearings on the guide posts 45. The locking plate 51 is tiltable, being fulcrumed on a transverse flange 56 on the top girth ring 37 a short distance in front of the spud. When tilted down at its heavier rear part it firmly holds the encircled spud. The locking of the spud is made positive by the provision of replaceable gripping pieces 57 held by clamps 58 and having bevelled edges extending towards the front surface of the spud. An adjustable bearer plate 59 secured on the locking plate 51 is directed towards the rear surface of the spud. A small adjustable plate 60 secured on the locking plate has an upwardly extending spacer piece 61.

The lifting plate 52 is similar to the locking plate 51 except that its forward extension 53 is shorter to clear the push rods 55, and it has near to its front an apertured lug 62 to which is secured one end of a cable 63 which is carried up, around the sheave 50, and down to be fixed at its other end to an apertured lug 64 on the spud frame 39.

Each of the spuds 29 and 30 may be raised by alternately extending and retracting the hydraulic cylinder 48. When the cylinder's piston is extended to raise the sheave 50, the cable 63 is tensioned to tilt and lift the lifting plate 52 which, gripping the spud, lifts it for a distance double the extension of the piston, the spud, while being raised, passing easily through the locking plate 50. As the cylinder is retracted, the lifting plate 52 moves easily down the spud which is locked against descent by the locking plate 51.

Either spud, after being raised, may be released to drop freely and drive into the sea-bed, indicated at 65, by retracting the piston of the hydraulic cylinder 48 somewhat further than is done during the lifting operation, so as to bring a pair of brackets 66 on the sides of the sheave carrier 49 down onto the push rods 55, depressing them and so forcing the front ends 54 of the locking plate 51 downwards. This causes the locking plate to be tilted to horizontal, its spacer piece 61 lifting the rear of the full descended locking plate also. The spud, no longer held by either the locking plate or the lifting plate is free to drop.

During dredging operations, the rear spud 30, driven into the sea bed, serves as the pivot about which the dredge is slewed.

To advance the dredge, the rear spud 30 being driven into the sea bed 65 and the front spud 29 raised, the hydraulic cylinder 34 is extended and the dredge is moved forwardly relative to the fixed spud 30.

So that the dredge operator in the cabin 67 can easily see the distance advanced, a cable 68 secured to the spud carriage 32 is carried forward to the gantry 21 and, as shown in FIG. 3, is carried up to one side of the gantry head beam 69 and across to the other side where it supports, through a pulley system, a weight 70 which maintains the cable 68 taut. A pointer 71 fixed to the cable moves across a graduated scale 72 on the head beam 69 as the dredge is advanced, to give clear visual indication of the extension of the hydraulic cylinder 34 and the distance the dredge is moved relative to the fixed rear spud 30.

To advance the dredge further, the front spud 29 is dropped, the rear spud 30 is raised, and the hydraulic cylinder 34 is retracted to bring the spud carriage 32 to fully advanced position, whereupon the rear spud 30 is again driven into the sea bed, the front spud 29 is raised, and so on.

We claim:

1. A dredge of the type having a hull on which are mounted a first spud and a second spud each vertically slidable and adapted to be driven down into a sea bed to anchor the hull, wherein:

said first spud is vertically slidable through a spud frame on a carriage mounted on said hull and adapted to be slidably moved longitudinally relative to said hull, said second spud is vertically slidable through a spud frame on a carrier fixed on said hull, for each said spud there is an associated lifting means for raising said associated spud, an associated locking means for holding said associated spud in raised position, and an associated release means for releasing said associated locking means to permit said associated spud to drop and drive into the sea bed, wherein said lifting means and said locking means comprise an apertured lifting plate disposed above an aperture locking plate, each of said plates being fitted closely about said associated spud and adapted to permit free passage of said associated spud therethrough when substantially perpendicular to said associated spud but to hold said associated spud frictionally when tilted, said locking plate being fulcrumed at one side on a fulcrum on said spud frame of said associated spud so as to tilt gravitationally and to lock said associated spud against descent while permitting said associated spud to be lifted by said lifting plate, said lifting means also including means for raising and lowering said lifting plate and tilting it when raising it to cause said lifting plate to grip and lift said associated spud, and propelling means are provided for advancing said hull relative to said spud carriage when, said second spud being raised, said first spud is driven into the sea bed.

2. A dredge according to claim 1 wherein:

said release means includes a release member adapted to be actuated by said raising means after said lifting plate has been lowered thereby onto said locking plate to move said locking plate about its fulcrum, whereby said locking plate moves said lifting plate superimposed thereon, from the tiled positions of said plates, holding said associated spud, to substantially horizontal positions, releasing said associated spud.

3. A dredge according to claim 2 wherein:

said raising means is a hydraulic cylinder mounted on the spud frame of the associated spud, its piston extending upwardly and carrying a sheave engaging a cable fixed at one end to said spud frame of the associated spud and at the other end to said associated lifting plate, and said release member includes push rods supported by said associated locking plate to the side of said associated locking plate's fulcrum remote from said associated spud, the push rods being adapted to be depressed by the full retraction of said hydraulic cylinder.

4. A dredge according to claim 1 wherein:

a gantry across the front part of said hull carries an indicator adapted to be moved laterally past a graduated scale on said gantry, means connecting said indicator operatively to said carriage and adapted to give a visual indication on said scale of the movement in either direction of said carriage.

* * * * *